US005582260A

United States Patent [19]

Murer et al.

[11] Patent Number: 5,582,260

[45] Date of Patent: Dec. 10, 1996

[54] CONTROL OF AT LEAST TWO STABILIZING ARMS IN A DRILL OR CORE DEVICE

[75] Inventors: Mario V. Murer, La Louviere; Rene L. Deschutter, Linkebeek, both of Belgium

[73] Assignee: Baroid Technology, Inc., Houston, Tex.

[21] Appl. No.: 302,714

[22] PCT Filed: Dec. 3, 1993

[86] PCT No.: PCT/BE93/00073

§ 371 Date: Jun. 22, 1995

§ 102(e) Date: Jun. 22, 1995

[87] PCT Pub. No.: WO94/13928

PCT Pub. Date: Jun. 23, 1994

[30] Foreign Application Priority Data

Dec. 4, 1992 [BE] Belgium ..... 09201068

[51] Int. Cl.[6] ..... E21B 7/06

[52] U.S. Cl. ..... 175/76; 175/325.1

[58] Field of Search ..... 175/61, 73, 76, 175/325.1, 325.3

[56] References Cited

U.S. PATENT DOCUMENTS

| | | | |
|---|---|---|---|
| 4,416,339 | 11/1983 | Baker et al. | 175/76 X |
| 4,471,843 | 9/1984 | Jones, Jr. et al. | 175/73 |
| 4,606,417 | 8/1986 | Webb et al. | 175/76 |
| 4,635,736 | 1/1987 | Shirley | 175/76 |
| 5,181,576 | 1/1993 | Askew et al. | 175/61 |
| 5,186,264 | 2/1993 | du Chaffaut | 175/76 X |
| 5,265,684 | 11/1993 | Rosenhauch | 175/73 X |
| 5,311,953 | 5/1994 | Walker | 175/61 |

*Primary Examiner*—Frank Tsay
*Attorney, Agent, or Firm*—Browning Bushman

[57] ABSTRACT

Control structure for extending and retracting at least two stabilizing arms (2) in a drill or core device, in particular stabilizing arms (2) in a drill or core bit (3), each arm (2) having an extremity pivoted around an axis (6) parallel to the axis (4) of the drill bit, comprising, per arm (2), a piston (8) provided for pivoting the arm (2) around said axis (6) so that it takes the arm to two extreme positions, a first position wherein it is housed in the bit (3) and a second position wherein it projects with respect to this bit. The control structure (10) and synchronization means (11) are provided respectively for displacing the pistons (8) under the influence of the drill fluid and for making the pistons (8) act substantially simultaneously in the same direction and to the same amplitude.

11 Claims, 2 Drawing Sheets

CONTROL OF AT LEAST TWO STABILIZING ARMS IN A DRILL OR CORE DEVICE

BACKGROUND OF THE INVENTION

The present invention concerns a control structure for at least two stabilizing arms in a drill or core device, in particular stabilizing arms in a drill or core bit, each arm being shifted with respect to the other over the circumference of the bit and having an extremity which is pivoted around an axis parallel to the axis of the drill bit in such a manner that the free extremity of the arm is behind said pivot axis with respect to the rotation direction of the bit during drilling.

DESCRIPTION OF THE PRIOR ART

The use of stabilizers having several stabilizing arms actuated by the drill fluid is common in the art. However, improvements are necessary for example in order to make the control structure of the arms more compact when it has to be integrated in a drill or core bit, and in order to reduce the number of mechanical components used in this control structure in order to reduce its cost and to increase its reliability.

SUMMARY OF THE INVENTION

To this end, the control structure according to the invention comprises, per arm, a piston provided for pivoting the arm around said axis so that the free extremity of the arm takes in two extreme positions, a first so-called rest position wherein the arm is housed in the bit and a second so-called operative position wherein said free extremity projects with respect to said bit. The control structure and a synchronization means are provided respectively for displacing the pistons under the pressure of the drill fluid and for making the pistons act substantially simultaneously in the same direction and to the same amplitude.

A separate control for each arm permits a reduction in the dimensions of the piston this so that this piston may be housed in the drill bit and may be connected directly to the concerned arm.

According to an advantageous embodiment of the invention, the longitudinal axes of the pistons are tangential to an imaginary cylinder coaxial to the bit, and preferably comprised in at least one plane transverse to the axis of the drill bit.

According to a particularly advantageous embodiment of the invention, the means for controlling the pistons comprise an annular piston which is coaxial to the bit. The annular piston is axially in a cylinder formed in the bit. The annular cylinder is shaped for being actuated by the drill fluid. Actuation of the annular cylinder acts on a control fluid which actuates each of said pistons and which is contained in the cylinder in communication with the chambers of the pistons.

In this way, the drill fluid comes only in contact with a minimum of elements composing the control structure which reduces or excludes the risk for clogging and wearing the control by materials composing this drill fluid or carried along by this fluid.

Other details and particularities of the invention will become apparent from the description of the drawings which are annexed to the present text and which illustrate, as a non limitative example, a particular embodiment of the control according to the invention.

DESCRIPTION OF THE PREFERRED EMBODIMENT

Figure 1:
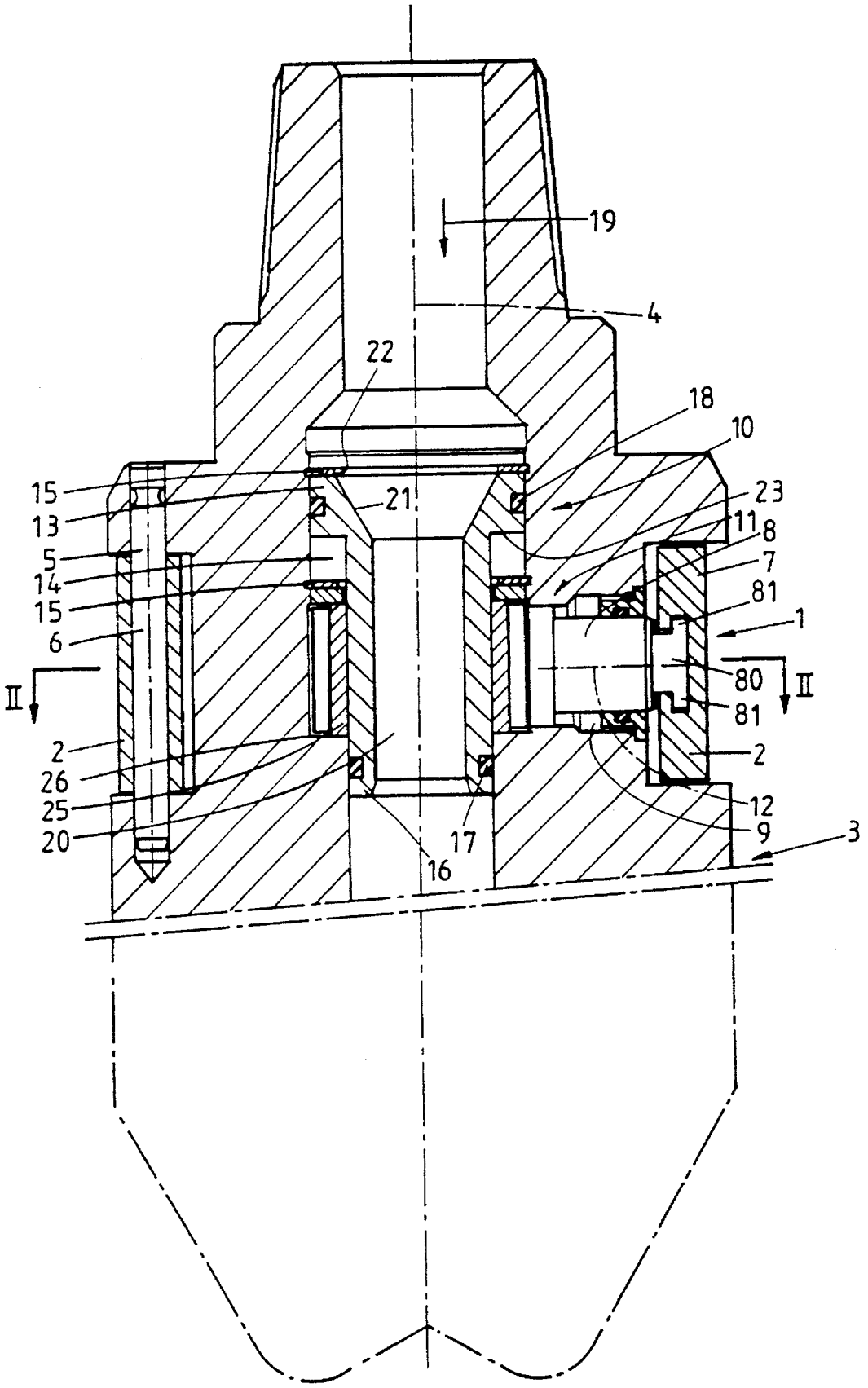
FIG. 1 shows, with breaks, a longitudinal section according to broken line I—I in FIG. 2 of a drill bit equipped with the arm control structure according to the invention.

In the different figures, the same reference numerals indicate identical or analogous elements.

The figures illustrate a control 1 of three stabilizing arms 2 disposed by means of example in a drill bit 3. For the simplicity of the graphical representation, the three arms 2 which are regularly distributed over a circumference of the bit 3 are situated on the same level of this bit with respect to the forward extremity of the bit 3 according to its progression into a hole during the drilling. The skilled man can easily conceive other distributions of the arms 2 as well over the circumference of the bit 3 as along the longitudinal axis 4 of this bit.

Each arm 2 is pivoted on one of its extremities in the drill bit 3 around a pivot 5, the axis 6 of which is parallel to the longitudinal axis 4 in such a manner that the opposite extremity 7 of the arm 2 is situated behind the pivot axis 6 with respect to the rotation direction 77 (FIG. 2) of the bit 3 during the drilling.

According to the invention, the control structure 1 comprises for each stabilizing arm 2 a piston 8 which is disposed in an appropriate chamber 9 and which is provided for pivoting the corresponding arm 2 around its axis 6, between two extreme positions. In a first extreme position, the so-called rest position shown in the figures, the arm 2 is housed in the bit 3 or at least within a cylinder which is coaxial to the bit 3 and which goes through the point or points of this bit which are the most remote from the longitudinal axis 4. In the second extreme position (not shown), the so-called operative position, the arms 2 project out of the bit 3 for a maximum distance determined by the stroke of each piston 8, this stroke being the same for the three pistons 8. As it is known, during the drilling the three arms 2 project out of the bit 3 so as to contact the wall of the drill hole in an operative position which is intermediate to the two above extreme positions. According to the figures, each arm 2 comprises advantageously for the connection to the corresponding piston 8, on its extremity 7, a T-groove extending substantially from the extremity 7 towards the pivot 5 in the face directed towards the piston 8. In its turn, the piston 8 shows a rod 80, the free extremity of which shows a T-shape adapted to the T-groove, the arms 81 of the T-shape being bulged in a biconvex way so as to allow the T-shape to articulate with a limited clearance in said groove during a displacement of the arm 2 by the piston 8.

Preferably, the control 1 comprises control structure means 10 described hereinafter for displacing each of the pistons 8 on the basis of the pressure difference in the drill fluid, between two locations in the flow of this liquid, and means 11 for synchronizing the pistons 8 so that they are displaced simultaneously with the same amplitude and in the same direction between rest position and operative position so as to maintain the drill bit 3 as coaxial as possible in the hole during the drilling, even in the case of a lack of circularity of this hole, and so as to oppose itself to the known lateral forces to which the bit 3 is subjected during the drilling.

Figure 2:
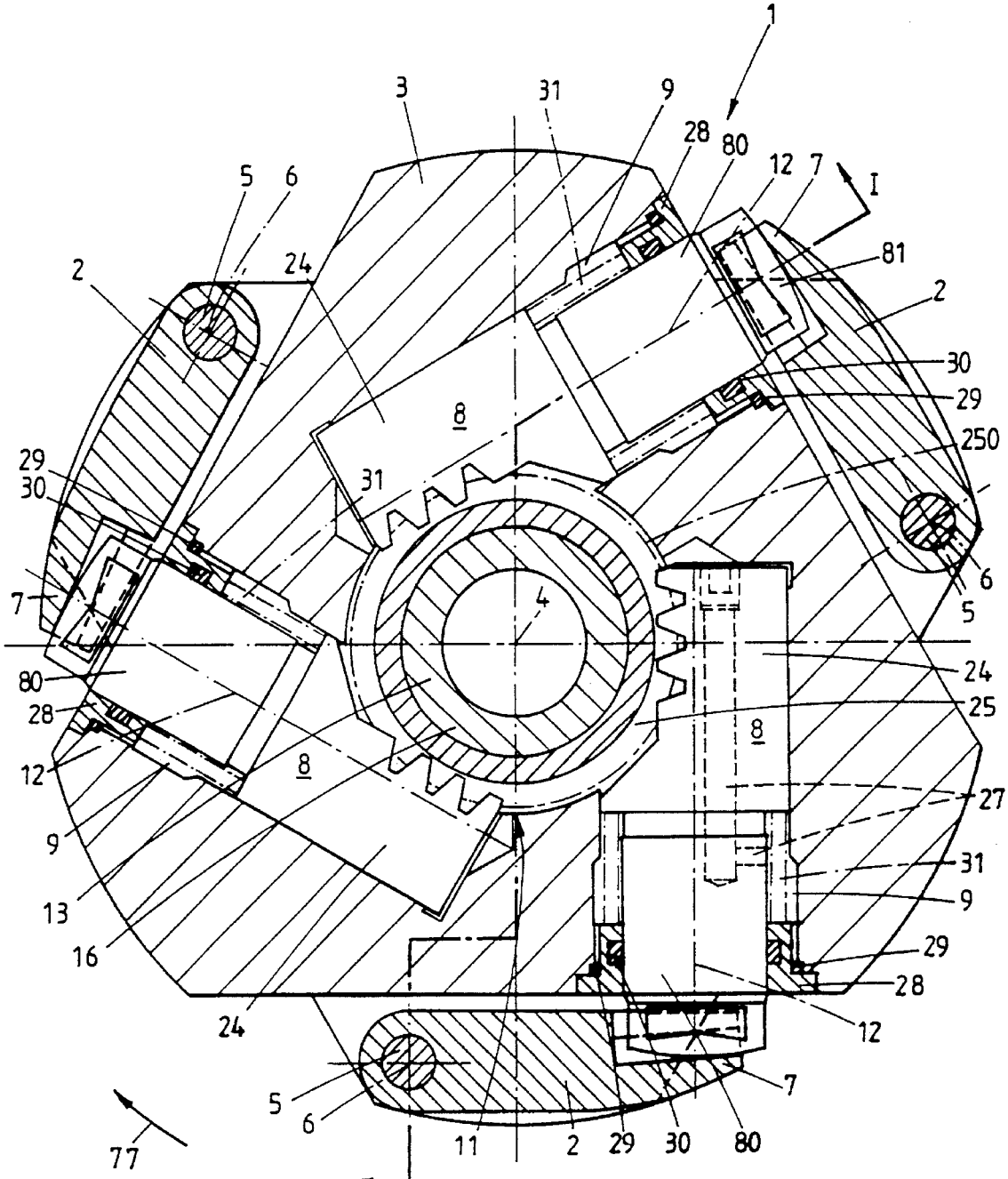
FIG. 2 is on a larger scale a transverse section according to line II—II of the control structure of FIG. 1.

According to a preferred embodiment of the invention, the longitudinal axes 12 of the pistons 8 are tangential to an imaginary cylinder coaxial to the bit 3 and the three axes 12 are advantageously comprised, at least in the case of the example shown in the figures, in the plane of the section of FIG. 2, at right angles to the longitudinal axis 4. A second group (not shown) of three pistons 8 could for example be provided in the same bit 3 in such a manner that their axes 12 would also be situated in another plane parallel to the plane of the above mentioned section.

The drill fluid may act directly onto the pistons 8. However, as already mentioned hereinabove and as it will appear clearly hereinafter, the drill liquid acts preferably indirectly, at least on one side, onto the pistons 8. To this end, the control means comprise an annular actuation piston 13 having the same axis 4 as the bit 3 and being arranged in a cylinder 14 formed in this bit. The displacement of the annular piston 13 is delimited for example by two appropriate circlips 15 disposed in the cylinder 14. The annular piston 13 comprises a hollow guiding rod 16 and is equipped on its outer surface with two annular gaskets 17 and 18, the role of which is explained hereinafter.

The annular piston 13 comprises an axial channel 20 provided for the flow of drill fluid towards the different nozzles of the drill bit 3. The inlet of this channel 20 according to the flow direction of the drill fluid (arrow 19) has a surface 21 in the shape of a truncated cone, the diameter of which reduces in the direction of the arrow 19. This truncated surface 21 as well as the end face 22 of the annular piston 13 situated upstream are destined to receive the pressure of the drill liquid which traverses the annular piston 13.

The annular piston 13 comprises also an annular surface 23, for example parallel to end face 22, which is situated opposite to this face 22 with respect to the gasket 18 and which delimits a volume of control fluid comprising hydraulic oil contained in cylinder 14 in order to press this oil out of cylinder 14 when the drill fluid displaces under its pressure the annular piston 13 into the direction of arrow 19. According to the example of the figures, the cylinder 14 and the chambers 9 of the pistons 8 are in communication so that the hydraulic oil pressed out of said cylinder 14 displaces each piston 8 in order to turn each arm 2 towards an operative position. The annular gaskets 17 and 18 prevent the hydraulic oil from escaping into the drill fluid as a result of the pressure to which it is subjected.

Preferably, said synchronization means 11 according to the invention comprise a toothed rack 24 cut for example in one piece in each piston 8 and meshing with a crown wheel 25 which is coaxial to the drill bit According to the invention, the crown wheel 25 is advantageously fitted into a tight chamber 26 situated in the extension of cylinder 14, downstream this cylinder with respect to the flow of the drill fluid. The crown wheel 25 rotates thus freely around the piston rod 16, which serves as its pivot, in function of the displacement of the pistons 8. In the assembly illustrated in FIG. 1, the crown wheel 25 is localized axially, on the one hand, by a ring retained by one of said circlips 15, situated on the downstream side of the cylinder 14, and on the other hand by the bottom of the chamber 26 situated on the downstream side of this chamber. The O-gasket 17 is situated onto the piston rod 16 downstream the bottom of chamber 26 in a boring which is suited to guide this piston rod 16 in a tight manner. The above-mentioned hydraulic oil fills in this way also the chamber 26 and serves as a lubricant for the rotation and for the meshing of the crown wheel 25. Moreover, chamber 26 provides for the oil the communication between cylinder 14 and the bottom of chambers 9, on the side opposite to the rods 80 of the pistons 8.

According to the invention, each piston 8 is preferably entirely subjected to the action of the hydraulic oil, which means that for example a duct 27 is formed through the piston 8 (FIG. 2, right piston) in order that the hydraulic oil is present on the two sides of the piston 8 in chamber 9 and, due to the working clearance, on the lateral face of the piston 8. In this way, a lubrication of the piston 8 is obtained and in this way the drill fluid is prevented from entering into the chambers 9 when the pistons 8 return into these chambers. This chamber 9 is sealed off from the outside of the drill bit 3 by a cover-band 28 which is known per se and which is provided with an O-gasket 29 between itself and the bit 3 and with a O-ring 30 between itself and the piston rod 80.

Each piston 8 comprises advantageously around its rod 80, the transverse section of which is smaller than the corresponding section of the piston 8, a return spring 31 of a predetermined strength. This spring 31 engages against the band 28 so as to push the piston 8 in the rest position when the drill fluid pressure is not sufficient to overcome the strength of this spring 31.

During the working of the drill bit 3, the pressure of the drill fluid flowing upstream the annular piston 13 is higher than the pressure of the fluid flowing in the drill hole, between the drill bit 3 and the wall of the hole. This pressure difference applied onto the truncated surface 21 and onto the end face 22 causes the annular piston 13 to displace into the direction of arrow 19, starting from the rest position shown in the figures. As a result of its displacement, the annular piston 13 expels the hydraulic oil contained in cylinder 14 towards the three chambers 9 through the chamber 26. The amount of oil expelled in this way to provide a receiving volume pushes each of the pistons 8 out of their chambers 9 towards the outside of the drill bit 3, the oil situated next to the rods 80 in the chambers 9 being sent automatically to the side of the bottoms of the chambers 9 through the ducts 27 so that it is added to the expelled amount of oil and so that the pistons 8 project further outwards. The pistons 8 push the corresponding arms 2 until they come into contact with the wall of the drill hole. The crown wheel 25 and the toothed racks 24 are arranged in order that during this movement, the three arms are displaced simultaneously and with a same amplitude so that they maintain or bring the drill bit 3 back into the axis of the hole by engaging all three said wall. By dimensioning the surfaces 21, 22 under the pressure of the drill fluid and under the force of the springs 31, the force of the stabilizing arms 3 can be adjusted in order to counteract the harmful lateral forces to which the bit 3 is subjected during the drilling and which tend to make it roll against the lateral wall of the hole.

The strokes and dimensions of the used elements can be easily calculated by the man skilled in the art.

For a drill bit 3 having a nominal diameter of 8 ½ inches (215.9 mm) and for a pressure difference of 100 psi (0.689 MPa), a force of 180 kg (1764N) can be obtained at the end of this arm 2 when one single arm 2 touches the wall of the hole and a force of 60 kg (588N) at the end of each arm 2 when the three arms 2 touch the wall, and this by the meshing of the crown wheel 25 with the three pistons 8 having toothed racks 24.

It has to be understood that the invention is in no way limited to the described embodiments and that many modifications can be applied thereto without leaving the scope of the invention.

In this way, the arms 2 may be provided with antiwear coatings and may show shapes which are the most suited for the hole during the drilling.

We claim:

1. A control structure for at least two stabilizing arms in a drill bit, each arm being shifted with respect to the other over the circumference of the bit and having an extremity which is pivoted around a pivot axis parallel to the axis of the drill bit in such a manner that a free extremity of each arm is situated behind said pivot axis with respect to the rotation direction of the bit during drilling, the control structure being characterized in that it comprises, per arm, a piston provided for pivoting the arm around said pivot axis so that the free extremity of the arm takes in two extreme positions, a first so-called rest position wherein the arm is housed in the bit and a second so-called operative position wherein said free extremity projects with respect to said bit, said control structure having synchronization means for displacing the pistons under the influence of drill fluid and for making the pistons act substantially simultaneously in the same direction and to the same amplitude.

2. A control structure according to claim 1, wherein the longitudinal axes of the pistons are tangential to an imaginary circle coaxial to the bit in at least one plane transverse to the axis of the drill bit.

3. A control structure according to either one of the claims 1 or 2, characterized in that the means for controlling the pistons comprise an annular actuator which is coaxial to the bit, provided for being displaced according to the common axis of the annular actuator and bit in a cylinder formed in the bit, said annular actuator being shaped for being actuated by the drill fluid and for acting on a control fluid which actuates each of said pistons and which is contained in the cylinder in communication with chambers containing the pistons.

4. A control structure according to either one of the claims 1 or 2, characterized in that the synchronization means comprise a toothed rack provided on each of the pistons and a crown wheel which is coaxial to the bit and which meshes with all of the toothed racks associated with the pistons.

5. A control structure according to claim 3 comprising a crown wheel mounted around an annular actuator in such a manner that said crown wheel can rotate freely around said annular actuator and is housed in a chamber which is in fluid communication with chambers containing the pistons.

6. A control structure according to claim 5, characterized in that each chamber containing each piston is arranged in such a manner that the piston is entirely subjected to the action of the control fluid, with a transverse section of a piston rod connected to each piston being smaller than the corresponding transverse section of the piston.

7. A control structure according to claim 4 comprising a crown wheel mounted around an annular actuator in such a manner that said crown wheel can rotate freely around said annular actuator and is housed in a chamber which is in fluid communication with chambers containing the pistons.

8. An extension and retraction control mechanism for controlling stabilizing arms in borehole drilling equipment comprising:

a tubular drilling tool extending axially along a central axis;

multiple extendable and retractable stabilizing arms carried by said drilling tool and adapted to be displaced laterally outwardly away from the central axis of said drilling tool in response to a first fluid pressure acting within said drilling tool; and a synchronizing mechanism connecting said stabilizing arms to each other for coordinating the lateral movement of said stabilizing arms relative to each other.

9. An extension and retracting control mechanism as defined in claim 8, wherein:

said synchronizing mechanism comprises a centrally disposed, rotatable wheel having circumferentially disposed gear teeth and a central, axially extending opening; and each of said stabilizing arms engages lateral pistons having rods equipped with gear teeth for meshing engagement with said gear teeth of said synchronizing mechanism whereby rotary movement of said wheel controls said lateral movement of said stabilizing arms through movement of said lateral pistons.

10. An extension and retraction mechanism as defined in claim 9, wherein:

a hydraulic fluid chamber is operatively connected with a central piston whereby axial movement of said central piston raises or lowers the pressure of hydraulic fluid in said chamber; and said lateral pistons are operatively connected with said chamber whereby said lateral pistons are moved laterally through said tool as the pressure of hydraulic fluid in said chamber is raised or lowered.

11. An extension and retraction mechanism as defined in claim 8, wherein:

said stabilizing arms include pivoting arm members having first and second arm ends;

said first arm ends are pivotably mounted to said tool whereby said second arm ends are adapted to be pivoted away from the central axis of said tool; and said second arm ends are connected to laterally movable piston actuators for moving said second arm ends laterally relative to the central axis of said tool.

* * * * *